US009782823B2

(12) United States Patent
Grunert et al.

(10) Patent No.: US 9,782,823 B2
(45) Date of Patent: Oct. 10, 2017

(54) FORGING DEVICE FOR THE PRODUCTION OF A PISTON BLANK, AND METHOD FOR THE PRODUCTION OF THE PISTON BLANK BY MEANS OF SAID FORGING DEVICE

(71) Applicant: MAHLE International GmbH, Stuttgart (DE)

(72) Inventors: Roland Grunert, Eberdingen (DE); Juergen Friedrich, Attendorn (DE); Timo Seng, Rottweil (DE); Wolfgang Janisch, Stuttgart (DE); Armin Wenzel, Rottweil (DE)

(73) Assignee: MAHLE International GmbH, Stuttgart (DE)

( * ) Notice: Subject to any disclaimer, the term of this patent is extended or adjusted under 35 U.S.C. 154(b) by 304 days.

(21) Appl. No.: 14/349,758

(22) PCT Filed: Oct. 5, 2012

(86) PCT No.: PCT/DE2012/000969
§ 371 (c)(1),
(2) Date: Apr. 4, 2014

(87) PCT Pub. No.: WO2013/050020
PCT Pub. Date: Apr. 11, 2013

(65) Prior Publication Data

US 2015/0020566 A1 Jan. 22, 2015

(30) Foreign Application Priority Data

Oct. 7, 2011 (DE) ..... 10 2011 115 048

(51) Int. Cl.

| | |
|---|---|
| ***B21K 1/18*** | (2006.01) |
| ***B21J 5/02*** | (2006.01) |
| ***B21J 13/02*** | (2006.01) |

(52) U.S. Cl.
CPC ..... *B21K 1/18* (2013.01); *B21J 5/025* (2013.01); *B21J 13/02* (2013.01); *B21J 13/025* (2013.01); *B21K 1/185* (2013.01)

(58) Field of Classification Search
CPC .... B21K 1/18; B21K 1/185; B21J 5/02; B21J 5/025; B21J 5/12; B21J 13/02;
(Continued)

(56) References Cited

U.S. PATENT DOCUMENTS 1,766,098 A * 6/1930 Booth ..... B21D 26/039 72/354.2
5,178,686 A * 1/1993 Schmid ..... C22C 21/08 148/439
(Continued)

FOREIGN PATENT DOCUMENTS

CH 90 356 A 9/1921
DE 101 13 629 A1 10/2002
(Continued)

OTHER PUBLICATIONS

German Search Report dated May 15, 2012 in German Application No. 10 2011 115 048.3 with English translation of relevant parts.
(Continued)

*Primary Examiner* — Gregory Swiatocha
(74) *Attorney, Agent, or Firm* — Collard & Roe, P.C.

(57) ABSTRACT

A forging device for producing a piston blank has a forging mold that has an essentially cylindrical cavity matching the radial outer surface of the piston blank, a forging base delimiting the cavity, and a central die consisting of a mandrel that has a conically tapering extension which is mounted on the mandrel and the shape of which matches the inner surface of the piston blank. In order to form the radially outer surfaces of the piston slipper walls and a peripheral cooling pocket located radially outside the slipper
(Continued)

Figure 2:
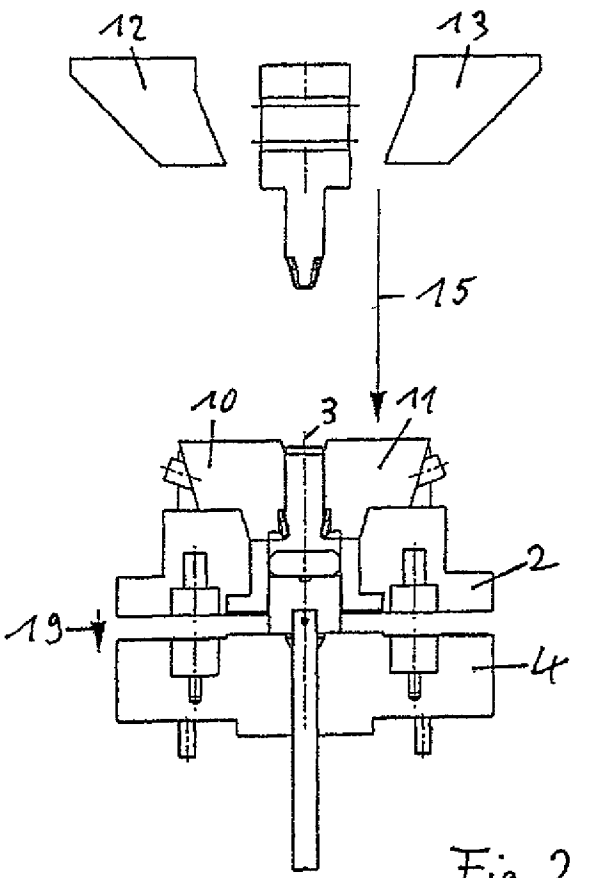

walls in the piston head, the forging device has two lateral jaws which are mounted in the forging device so as to be movable at an angle to the longitudinal axis of the forging device.

6 Claims, 3 Drawing Sheets

(58) Field of Classification Search
CPC .. B21J 13/025; B21J 9/02; B21J 9/027; B23P 15/10
USPC ..... 72/352, 353.2, 353.6, 354.6, 356, 357, 72/358, 354.2, 360
See application file for complete search history.

(56) References Cited

U.S. PATENT DOCUMENTS 5,619,882 A * 4/1997 Godtner ..... B21J 5/12 72/351
5,862,701 A * 1/1999 Bishop ..... B21K 1/767 72/353.2
6,152,017 A * 11/2000 Harrer ..... F02F 3/00 92/208
6,205,836 B1 * 3/2001 Yamagata ..... B22D 18/02 72/359
6,530,149 B2 * 3/2003 Sugiura ..... F04B 27/0878 29/888.04
7,213,337 B1 * 5/2007 Porto ..... B21J 5/02 29/557
2008/0134876 A1 * 6/2008 Scharp ..... F02F 3/22 92/168
2009/0116932 A1 * 5/2009 Kihara ..... B21C 23/186 411/369
2010/0107999 A1 * 5/2010 Scharp ..... F02F 3/003 123/41.35
2010/0147251 A1 * 6/2010 Blau ..... F02F 3/00 123/193.6
2011/0114054 A1 * 5/2011 Miller ..... F02F 3/00 123/193.6

FOREIGN PATENT DOCUMENTS

GB 2 216 447 A 10/1989
JP 63-119944 A 5/1988
JP 2000-005840 A 1/2000

OTHER PUBLICATIONS

International Search Report of PCT/DE2012/000969, mailed Mar. 7, 2013.

* cited by examiner

FORGING DEVICE FOR THE PRODUCTION OF A PISTON BLANK, AND METHOD FOR THE PRODUCTION OF THE PISTON BLANK BY MEANS OF SAID FORGING DEVICE

CROSS REFERENCE TO RELATED APPLICATIONS

This application is the National Stage of PCT/DE2012/000969 filed on Oct. 5, 2012 which claims priority under 35 U.S.C. §119 of German Application No. 10 2011 115 048.3 filed on Oct. 7, 2011, the disclosure of which is incorporated by reference. The international application under PCT article 21(2) was not published in English.

The invention relates to a forging apparatus for the production of a piston blank that has a piston crown and skirt elements attached to the piston crown, which are connected with one another by way of box walls, having a forging mold with an essentially cylindrical and continuous recess, corresponding to the radial outer surface of the piston blank, having a forging base that delimits the one side of the recess, and having a center die that consists of a mandrel with a conically tapering extension mounted on the mandrel, the shape of which extension corresponds to the inner surface of the piston blank, and which mandrel can be introduced into the forging mold by way of the other side of the recess, with the extension leading.

The invention furthermore relates to a method for forging of a piston blank that has a piston crown and skirt elements attached to the piston crown, which are connected with one another by way of box walls, having the following method steps:

- introduction of a heated billet from which the piston blank is to be forged into an essentially cylindrical recess of a forging apparatus, in such a manner that it comes to lie on a forging base disposed on the one side of the recess,
- introduction of a center die that consists of a mandrel with a conically tapering extension mounted on the mandrel, the shape of which extension corresponds to the inner surface of the piston blank, into the other side of the recess, with the extension leading, wherein the extension acts on the billet and, in this connection, the box walls and the skirt elements connected with them are formed,
- extraction of the center die from the recess of the forging apparatus,
- ejection of the piston blank.

A forging apparatus for the production of a piston blank and a method for forging of the piston blank, using the forging apparatus of the type stated initially, are known from the Japanese patent application JP 2000 005840 A. It is disadvantageous, in this connection, that the forging mold consists of two halves that are pulled apart in the radial direction after the forging process has been completed, in order to be able to eject the piston blank. Using the known forging mold, it is impossible to mold cooling pockets that run radially outside of the box walls into the top of the billet, because these cooling pockets would prevent the forging mold from being pulled apart in the radial direction.

It is the task of the present invention to structure a forging apparatus in such a manner that a circumferential cooling pocket can be molded into the top of the billet, radially outside of the box walls. Furthermore, it is the task of the invention to indicate a method for forging of the piston blank, using the forging apparatus, with which method a circumferential cooling pocket is molded into the top of the billet, radially outside of the box walls.

These tasks are accomplished, for one thing, in that the forging mold has two lateral jaws, which are mounted in the forging apparatus at a slant relative to the longitudinal axis of the forging apparatus, so that they can be moved in directions that can be represented by arrows that lie at a slant, for molding of the radially outer surfaces of the box walls and for molding of a circumferential cooling pocket disposed in the piston crown radially outside the box walls, wherein the arrows that lie at a slant enclose an acute angle with the longitudinal axis of the forging apparatus.

During forging of the piston blank, using the forging apparatus, this task is accomplished, for another thing, by means of the following method steps:

- molding of a circumferential cooling pocket into the billet, using two lateral jaws, the inner surfaces of which have the shape of the radial outer surfaces of the box walls, and which are mounted in the forging apparatus at a slant relative to the longitudinal axis of the forging apparatus, so that they can be moved in directions that can be represented by arrows that lie at a slant, wherein the arrows that lie at a slant enclose an angle of 25° with the longitudinal axis of the forging apparatus and run toward one another in the direction of the forging base, in that the lateral jaws are pressed onto the billet,
- extraction of the lateral jaws from the forging apparatus in directions opposite to the arrows that lie at a slant.

Advantageous embodiments of the invention are the object of the dependent claims.

Figure 1:
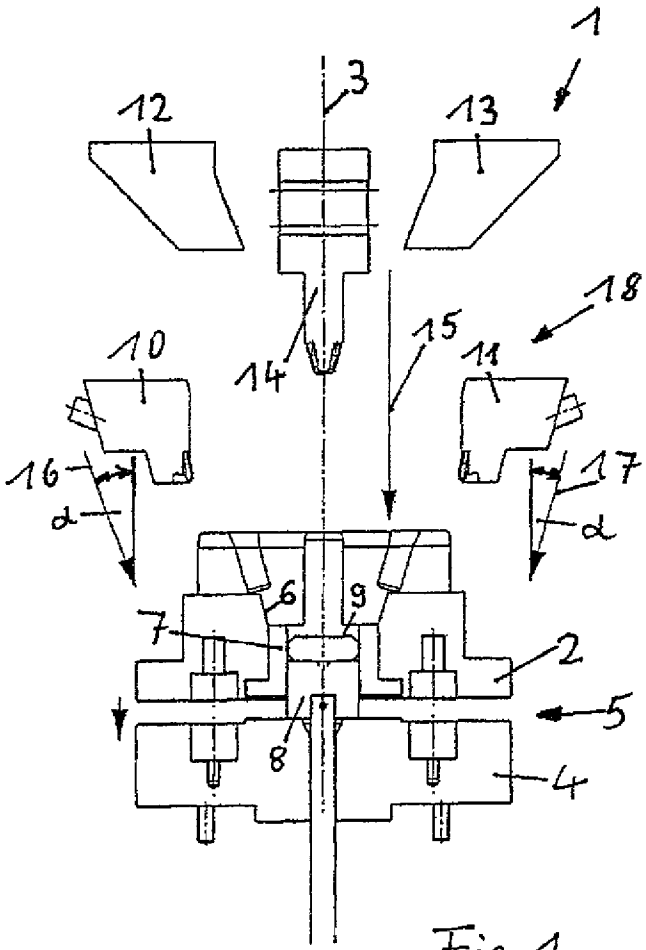
Figure 6:
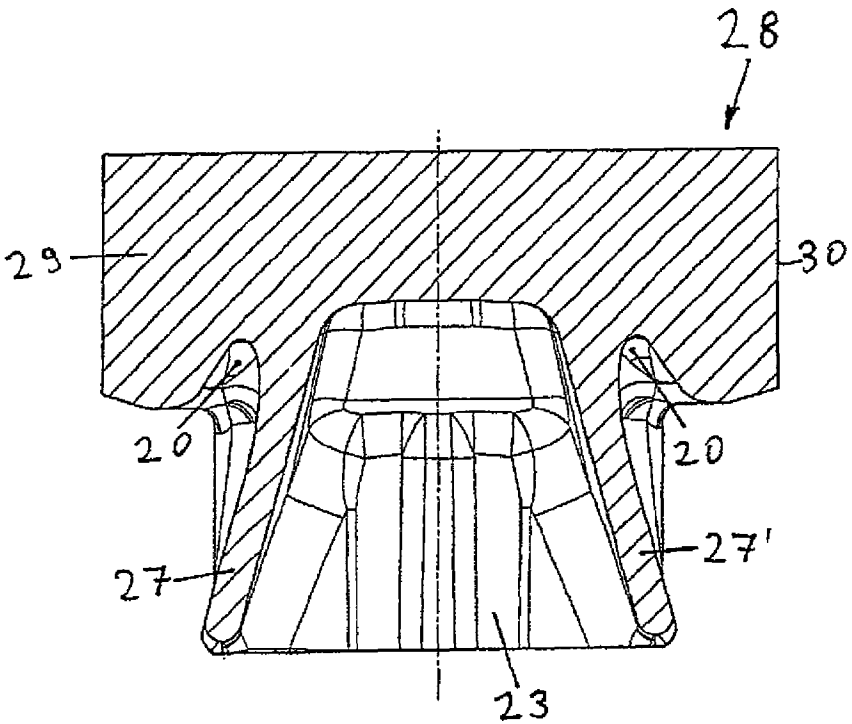

An exemplary embodiment of the invention will be described below, using the drawings. These show:

FIG. 1 parts of a forging apparatus in the starting position, with a billet composed of aluminum placed in it, from which billet a piston blank is produced during the course of the forging process, FIGS. 2 to 5 process steps that take place in the forging apparatus for the production of the piston, and FIG. 6 a section through the piston produced in the forging apparatus.

FIG. 1 shows a forging apparatus 1 for die-pressing, which has a die mantle 2 that is connected with a die plate 4, so as to be displaceable in the direction of the longitudinal axis 3. At the center, the die mantle 2 has a round opening 6, in which a die bushing 7 is disposed, the function of which consists in guiding a forging base 8 and a center die 14. Furthermore, the outside diameter of the piston blank 28 is established by way of the inside diameter of the die bushing 7 (FIG. 6). In this connection, the die mantle 2, the die plate 4, and the die bushing 7 form the lower die 5.

The forging base 8 situated in the interior of the die bushing 7 lies on a die plate 4. A billet 9, from which the piston blank 28 (FIG. 6) is produced, lies on the forging base 8. The billet 9 consists of AlSi12CuMgNi or of AlSi12Cu3Ni2Mg, and has a temperature of 480° C.

The further parts of the forging apparatus 1, namely lateral jaws 10 and 11 and hold-down devices 12 and 13, are attached to a hydraulic apparatus, not shown in FIG. 1, next to the center die 14. While the hold-down devices 12, 13 and the center die 14 are mounted so that they can be moved in the direction of the arrow 15 that lies parallel to the longitudinal axis 3 of the forging apparatus 1, the lateral jaws 10 and 11 are mounted so that they can be moved in the direction of the arrows 16 and 17 that lie at a slant, wherein the arrows 16 and 17 that lie at a slant enclose an angle $\alpha=20°$ with the longitudinal axis 3 and run toward one another in the direction of the lower die 5. In this connection, the lateral jaws 10, 11 and the center die 14 form the upper die 18, which is configured in three parts in the present exemplary embodiment. The lateral jaws 10, 11, the hold-down devices 12, 13, and the center die 14 are disposed symmetrically relative to the longitudinal axis 3 of the forging apparatus 1.

Within the scope of the method for forging of the piston blank 28, first the lateral jaws 10 and 11 are moved downward, in the direction of the arrows 16 and 17 (FIG. 1), to such an extent until they lie on the die mantle 2, as shown in FIG. 2.

Figure 3:
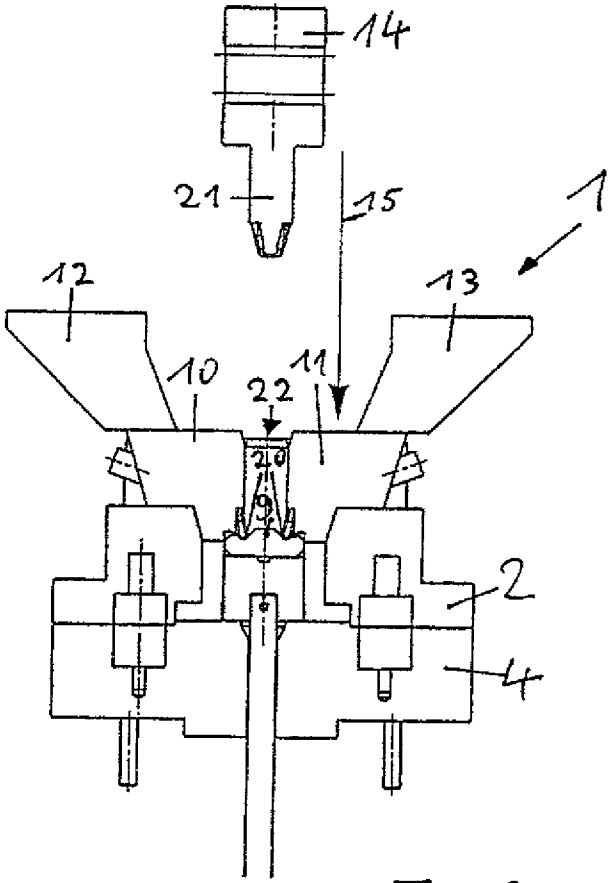

Subsequently, the hold-down devices 12 and 13 are moved in the direction of the arrow 15, downward, toward the lateral jaws 10 and 11 (FIG. 2), until they lie on the lateral jaws 10 and 11, as shown in FIG. 3. The die mantle 2 is then moved toward the die plate 4, together with the lateral jaws 10 and 11 and the hold-down devices 12 and 13, in the direction of the arrow 19 that lies parallel to the longitudinal axis 3 of the forging apparatus 1 (FIG. 2), until the die mantle 2 lies on the die plate 4, as shown in FIG. 3. In this connection, a circumferential cooling pocket 20, which can be recognized well in FIG. 6, is molded into the billet 9 by the lateral jaws 10 and 11.

Figure 4:
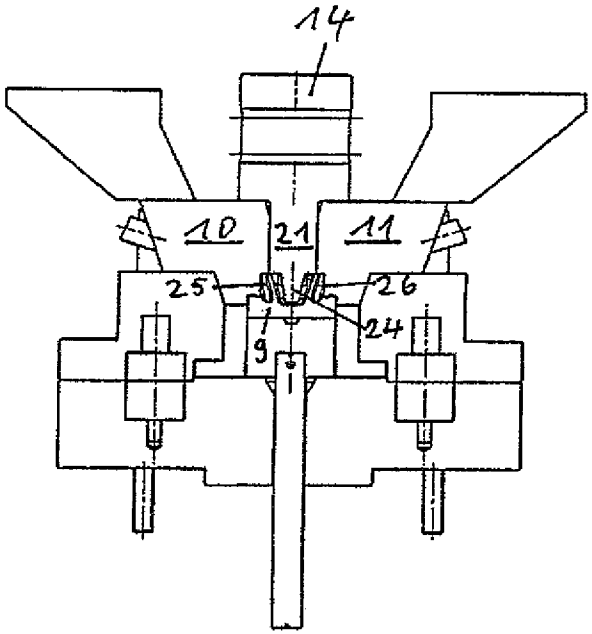

In the subsequent method step (FIG. 3), the center die 14 is moved toward the forging apparatus 1 in the direction of the arrow 15, whereby the mandrel 21 moves into the opening 22 between the lateral jaws 10 and 11 and, as shown in FIG. 4, acts on the billet 9 to such an extent that the skirt elements 23 and the box walls 27, 27' are formed between the mandrel 21 of the center die 14 and the lateral jaws 10, 11, as this happens (FIG. 6).

For this purpose, the mandrel 21 has an extension 24 that tapers conically downward, which extension, together with the inner walls 25, 26 of the lateral jaws 10, 11, which also taper conically downward, ensure that the box walls 27, 27' of the piston blank 28 stand at a slant and taper conically toward the piston crown 29 of the piston blank 28, as shown in FIG. 6.

The outer surface of the piston blank 28 is molded by a forging mold that consists of the lateral jaws 10, 11 and the die bushing 7. The radially outer, cylindrical mantle surface 30 of the piston crown 29 is molded by the die bushing 7, in this connection, while the lateral jaws 10, 11 are responsible for molding of the radially outer surfaces of the box walls 27, 27' and of the circumferential cooling pocket 20.

Figure 5:
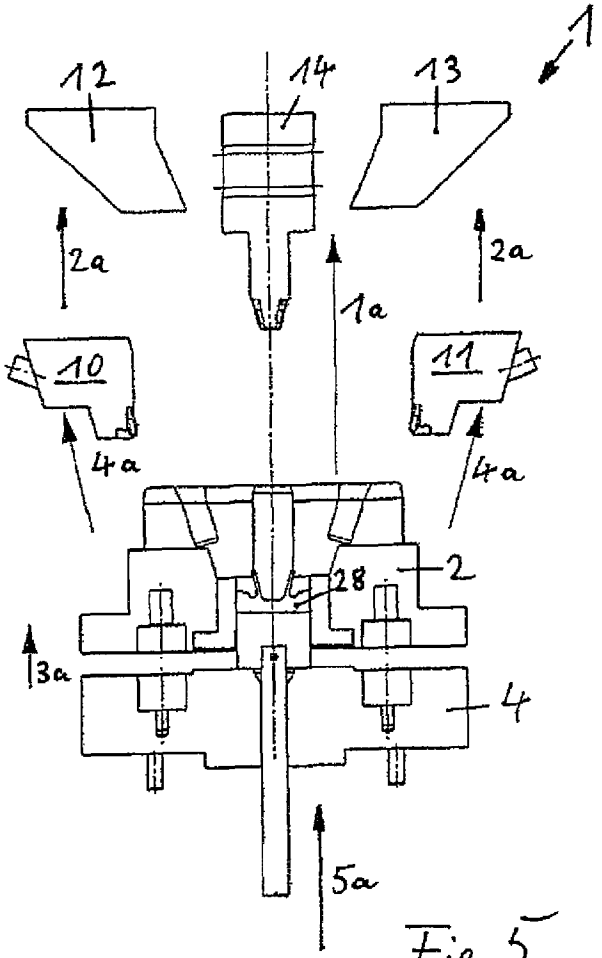

In FIG. 5, the steps during opening of the forging apparatus 1 after completion of the forging process are shown:

1*a*: The center die 14 moves upward.

2*a*: The hold-down devices 12, 13 move upward.

3*a*: The die mantle 2 moves upward, whereby the die plate 4 remains standing in place.

4*a*: The lateral jaws 10, 11 are pulled away upward at a slant, relative to the piston blank 28.

5*a*: The piston blank 28 is ejected.

In FIG. 6, the piston blank 28, made of aluminum, produced within the scope of the forging process described above is shown. Aside from a circumferential cooling pocket 20 that is forged in, the piston blank 28 has slanted box walls 27, 27' that run toward one another in the direction of the piston crown 29, which walls connect the skirt elements 23 with one another, and have the advantage that a piston produced from a piston blank 28, using chip-removing production methods, is able to withstand very much greater stress than a piston having box walls that lie parallel to one another.

REFERENCE SYMBOL LIST

1*a*, 2*a*, 3*a*, 4*a*, 5*a* steps during opening of the forging apparatus 1
1 forging apparatus
2 die mantle
3 longitudinal axis
4 die plate
5 lower die
6 opening
7 die bushing
8 forging base
9 billet
10, 11 lateral jaws
12, 13 hold-down device
14 center die
15, 16 arrows lying at a slant
17 arrow
18 upper die
19 arrow
20 cooling pocket
21 mandrel of the center die 14
22 opening between the lateral jaws 10, 11
23 skirt element
24 extension of the mandrel 21
25, 26 inner walls of the lateral jaws 10, 11
27, 27' box wall
28 piston blank
29 piston crown
30 radial outer mantle surface of the piston crown 29

The invention claimed is:

1. A forging apparatus (1) for the production of a piston blank (28) that has a piston crown (29) and skirt elements (23) attached to the piston crown (29), which are connected with one another by way of box walls (27, 27'), comprising:

a forging mold (7, 10, 11) with a cylindrical and continuous recess, corresponding to a radial outer surface of the piston blank (28), a forging base (8) that delimits a first side of the recess, and a center die (14) that consists of a mandrel (21) with a conically tapering extension (24) mounted on the mandrel, the shape of which extension corresponds to an inner surface of the piston blank, and which mandrel is configured to be introduced into the forging mold (7, 10, 11) by way of a second side of the recess, with the extension (24) leading, wherein the forging mold (7, 10, 11) has two lateral jaws (10, 11), which are mounted in the forging apparatus (1) at a slant relative to a longitudinal axis (3) of the forging apparatus (1), so that they are configured to be moved in directions that lie at a slant to the longitudinal axis of the forging apparatus, the lateral jaws being configured for molding of radially outer surfaces of the box walls (27, 27') and for molding of a circumferential cooling pocket (20) disposed in the piston crown (29) radially outside the box walls (27, 27'), the cooling pocket being formed by a circumferential indentation in an underside of the piston crown, said circumferential indentation extending upward into the piston crown above a bottom of the piston crown, wherein the directions of movement of the lateral jaws enclose an angle of $\alpha \leq 25°$ with the longitudinal axis (3) of the forging apparatus (1) and run toward one another in the direction of the forging base (8).

2. The forging apparatus (1) according to claim 1, wherein the forging mold (7, 10, 11) has a tubular die bushing (7) disposed on the first side of the recess, for molding of a radially outer mantle surface (30) of the piston crown (29).

3. A method for forging of a piston blank (28) that has a piston crown (29) and skirt elements (23) attached to the piston crown (29), which are connected with one another by way of box walls (27, 27'), using a forging apparatus (1) according to claim 1, comprising the following method steps:

introducing a heated billet (9) from which the piston blank (28) is to be forged into a cylindrical recess of the forging apparatus (1), in such a manner that the heated billet comes to lie on a forging base (8) disposed on a first side of the recess, molding a circumferential cooling pocket (20) into the billet (9), using two lateral jaws (10, 11), the cooling pocket comprising a circumferential indentation in an underside of the piston crown, said circumferential indentation extending upward into the piston crown above a bottom of the piston crown, the lateral jaws having inner surfaces that have a shape of radial outer surfaces of the box walls (27, 27'), and which are mounted in the forging apparatus (1) at a slant relative to a longitudinal axis (3) of the forging apparatus (1), so that the lateral jaws are configured to be moved in directions that lie at a slant to the longitudinal axis, wherein the directions of movement enclose an angle of $\alpha \leq 25°$ with the longitudinal axis (3) of the forging apparatus (1) and run toward one another in the direction of a forging base (8), in that the lateral jaws (10, 11) are pressed onto the billet (9), introducing a center die (14) that consists of a mandrel (21) with a conically tapering extension (24) mounted on the mandrel, a shape of which extension corresponds to an inner surface of the piston blank, into a second side of the recess, with the extension (24) leading, wherein the extension (24) acts on the billet (9) and forms the box walls (27, 27') and the skirt elements (23) connected with them extracting the center die (14) from the recess of the forging apparatus (1), extracting the lateral jaws (10, 11) from the forging apparatus (1) in directions opposite to the slanted directions of movement of the lateral jaws, and ejecting the piston blank (28).

4. The method for forging of a piston blank (28) according to claim 3, wherein the billet (9) consists of an aluminum alloy and is heated to a temperature of 480° C.

5. The method for forging of a piston blank (28) according to claim 4, wherein the alloy AlSi12CuMgNi is chosen for the billet (9).

6. The method for forging of a piston blank (28) according to claim 4, wherein the alloy AlSi12Cu3Ni2Mg is chosen for the billet (9).

* * * * *